US007533727B2

(12) United States Patent
Barton et al.

(10) Patent No.: US 7,533,727 B2
(45) Date of Patent: May 19, 2009

(54) OIL WELL COMPLETION TOOL HAVING SEVERABLE TUBING STRING BARRIER DISC

(75) Inventors: John A. Barton, Arlington, TX (US); Mark Burris, Iola, KS (US); Donald R. Hibler, Jr., Bates City, MO (US); Daniel O'Halloran, Oak Grove, MO (US); Joel Wicoff, Iola, KS (US)

(73) Assignee: Fike Corporation, Blue Springs, MO (US)

( * ) Notice: Subject to any disclaimer, the term of this patent is extended or adjusted under 35 U.S.C. 154(b) by 53 days.

(21) Appl. No.: 11/858,561

(22) Filed: Sep. 20, 2007

(65) Prior Publication Data

US 2008/0271883 A1 Nov. 6, 2008

Related U.S. Application Data

(63) Continuation-in-part of application No. 11/744,605, filed on May 4, 2007, now abandoned.

(51) Int. Cl.
*E21B 34/10* (2006.01)

(52) U.S. Cl. ..... 166/317; 137/68.21; 137/68.27; 137/68.29

(58) Field of Classification Search ..... 166/317; 137/68.21, 68.27, 68.29
See application file for complete search history.

(56) References Cited

U.S. PATENT DOCUMENTS 2,958,545 A * 11/1960 Stelzer ..... 285/3
3,779,263 A 12/1973 Edwards et al.
4,609,005 A 9/1986 Upchurch
4,658,902 A 4/1987 Wesson et al.
4,969,524 A * 11/1990 Whiteley ..... 166/278
5,161,738 A * 11/1992 Wass ..... 236/92 C
5,647,390 A * 7/1997 Wass ..... 137/68.12
5,996,696 A 12/1999 Jeffree et al.
RE39,209 E 8/2006 Barton

OTHER PUBLICATIONS

WO 98/04806; Feb. 5, 1998.

* cited by examiner

*Primary Examiner*—Hoang Dang
(74) *Attorney, Agent, or Firm*—Hovey Williams LLP

(57) ABSTRACT

An oil well completion tool having a tubular assembly defining an elongated main passage is adapted to be connected to a multiple-section tubing string within an oil well casing. A severable plug is mounted in the tubular assembly in normal blocking relationship to the passage. A movable shear cylinder unit has a plug-severing edge operable to sever an entire central segment of the plug from a remaining peripheral portion thereof. Separate hinge structure has an elongated U-shaped leg portion connected to the central segment of the plug. The leg portion of the hinge structure, which undergoes elongation, is operable to retain the severed central segment of the plug in the main passage while allowing the central segment of the plug to bodily shift independent of and in a direction away from the peripheral portion of the plug. The severed central segment is received in a recess therefor in the tubular assembly wall structure in order to prevent interference of the severed central plug segment with the main passage.

25 Claims, 8 Drawing Sheets

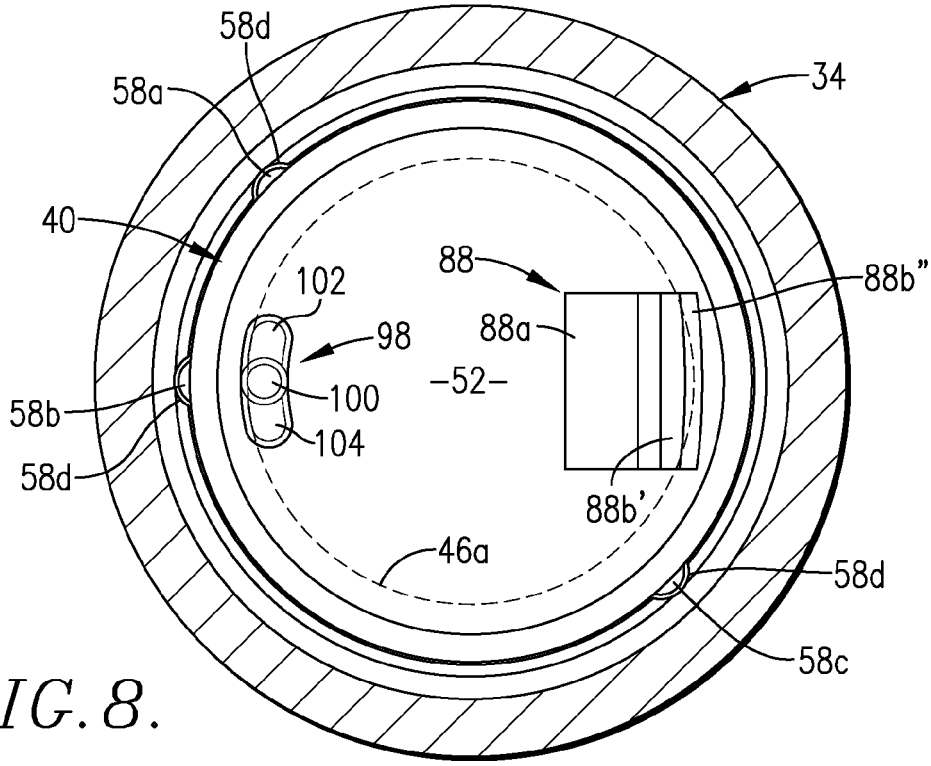
FIG. 8.
FIG. 9.
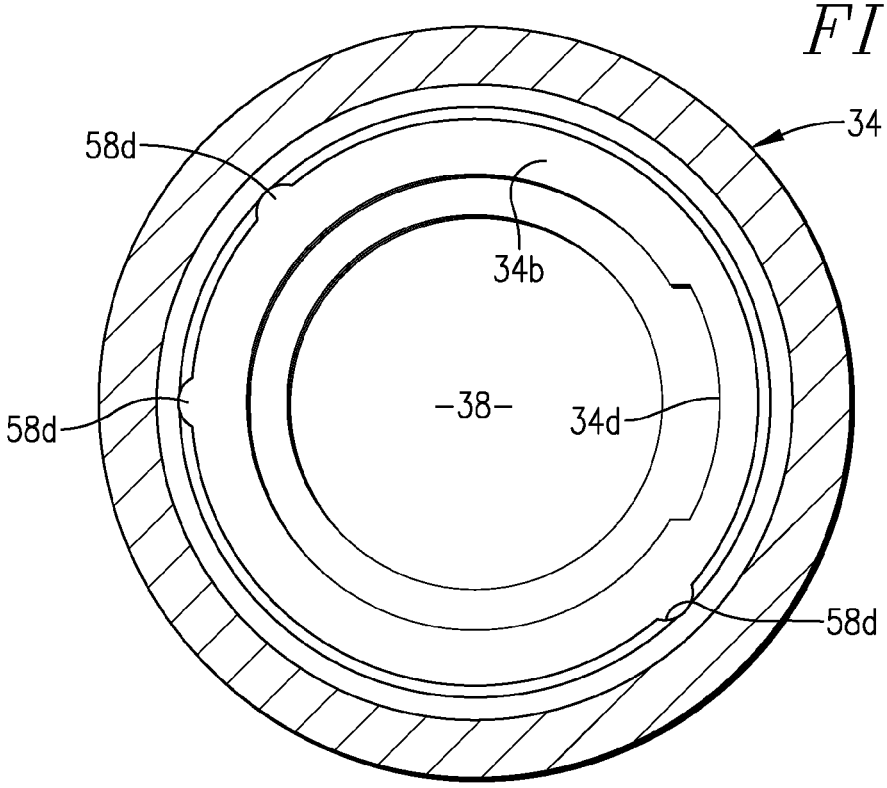

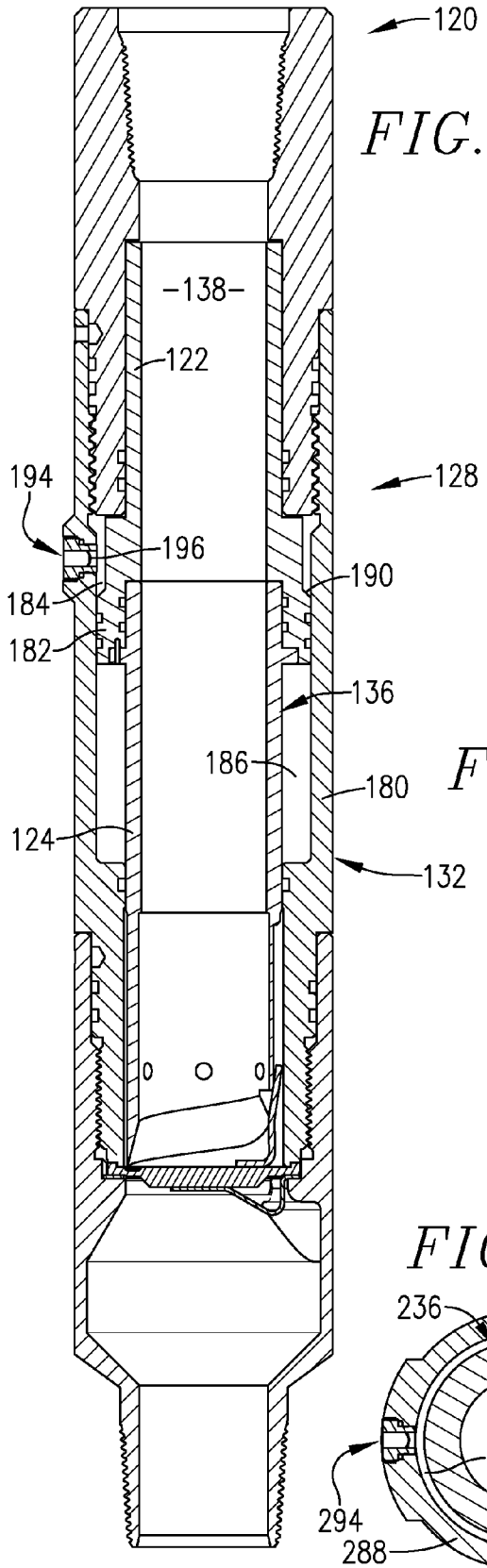
FIG. 13.
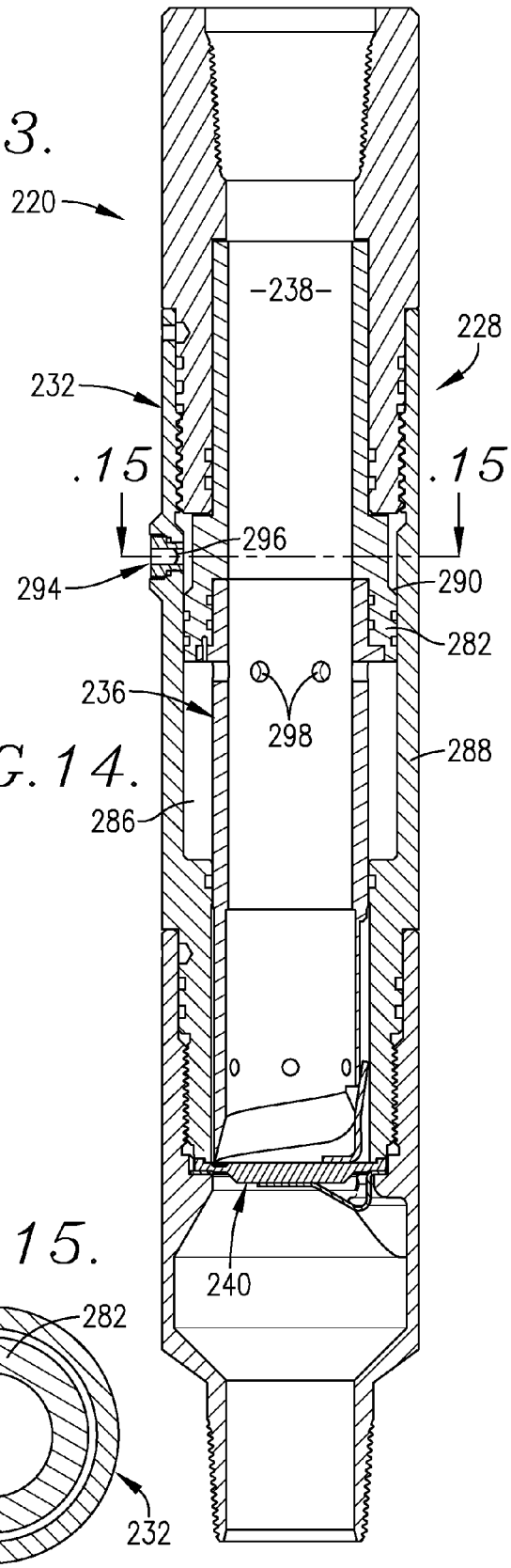
FIG. 14.
FIG. 15.
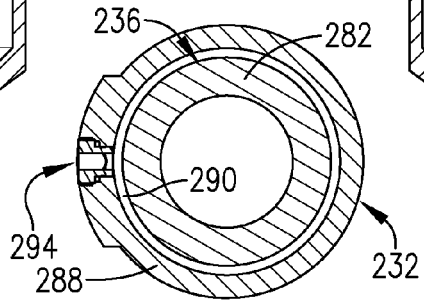

OIL WELL COMPLETION TOOL HAVING SEVERABLE TUBING STRING BARRIER DISC

CROSS-REFERENCE TO RELATED APPLICATION

This application is a continuation-in-part of U.S. patent application Ser. No. 11/744,605, filed May 4, 2007, now abandoned incorporated by reference herein.

BACKGROUND OF THE INVENTION

1. Field of the Invention

This invention relates to an oil well completion tool that is adapted to be interposed in a multiple-section tubing string within an oil well casing, most usually above another oil well tool, such as a packer. The completion tool allows the tubing string to be blocked, for example, in order to allow setting of a packer or the like, and to thereafter be fully opened for production from the well.

2. Description of the Prior Art

Typically when oil or gas wells are drilled in hydrocarbon-bearing formations, the bore hole is thereafter isolated from the surrounding formation by a string of interconnected, relatively large diameter pipe sections, generally referred to as a well casing. The casing sections may, for example, be about 5 inches to about 9 inches in diameter. Cement is most often placed around the casing throughout its length to provide a barrier between the outside of the casing and the inside of the bore hole of the well. The cement acts to prevent communication of fluids and gases under pressure from one underground formation to the next.

A tubing string fabricated from smaller diameter individual pipe sections interconnected end-to-end is commonly run into the well within the casing. During completion of a typical cased well, a tool such as a packer may be provided on the end of the tubing string to isolate the area called an annulus between the inside of the casing and the outside of the tubing string. There are many types of oil well packers in use, with elastomeric sleeves or bladders engageable with the interface of the casing being expanded and "set" either mechanically, by inflation, hydraulically, or using a wire line set. Mechanical packers are generally actuated by rotation of the string which compresses the sleeves to bring the outer surfaces thereof into sealing engagement with the casing.

Hydraulic packers offer many installation and operating advantages, particularly where the well casing has a number of bends and therefore is not essentially straight throughout its length, or requires installation in a horizontal well bore, making a mechanical packer impractical. In the case of a hydraulic packer, it is necessary to provide a plug within the casing below the packer to offer resistance to the hydraulic pressure required for setting of the packer bladders. Once the packer is set, the plug must be opened fully in order for oil production to be initiated. Hydraulic packers are only one example of downhole tools that require pressurized hydraulic fluid to function.

In well stimulation operations, it is common to "surge" the formation in order to clean debris from the formation and improve the flow of hydrocarbons. Surging is accomplished by reducing the pressure inside of the tubing string by an amount below that of the formation pressure and allowing this difference in pressure to equalize very rapidly. Another example of well stimulation involves increasing the fluid pressure within a tubing string to a value substantially above the formation pressure. When the pressure in the tubing string is released rapidly as compared with the formation pressure, fractures in the formation are created such that hydrocarbons can be produced without traveling through damaged rock from well drilling and completion operations.

In these examples, as is the case with other exemplary completion processes, it is advantageous that immediately after functioning as a tool is initiated or stimulation is undertaken, the plug be completely removed from the flow path of the well.

The prior art is replete with exemplary tools for assisting in setting of packers and similar well annulus isolation devices. Many of these tools utilize a plug for temporarily blocking a tubing string in order that hydraulic pressure on a packer or the like may be applied to the tool. Certain plugs have been run on a wire line and set in place. After the pressure operation, the line is retrieved to pull the plug to the surface. This type of operation has been found to be time-consuming and presents associated risks with well intervention.

Other well casing isolation tools have been provided with tubing string blocking devices such as glass or ceramic plugs. These plugs have been opened either by dropping a bar from the surface, which causes plug failure, or overpressuring the plug to failure. Many unsolved problems and safety concerns have arisen by use of these types of plugs, in that the material is frangible and thus subject to micro-fractures resulting from rough handling at the well surface, improper assembly in the tool, or tolerance issues that greatly reduce their pressure ratings, causing unpredictable plug failure.

A pressure responsive rupture valve, especially useful for surging an oil well, in U.S. Pat. No. 3,779,263, employs a tubular cutting sleeve shifted by a pressure responsive tubular piston. The main valve passage communicates directly with the chamber of the piston. Upon pressurization of the piston chamber by fluid introduced into the valve passage, the piston-actuated cutting sleeve is shifted toward a rupture disc normally blocking the passage through the valve. The disc is deeply scored by a series of radially oriented score lines. When the multi-angular cutting edge of the cutting sleeve engages the disc, it breaks up as a series of individual petals that fold outwardly toward the wall structure of the valve.

The valve of U.S. Pat. No. 4,609,005 relies upon a tubular cutting mandrel for severing a portion of a disc normally blocking the passage through the valve housing while leaving a narrow uncut section by virtue of an elongated slot in the operating edge of the cutting mandrel. As is apparent from FIG. 2 of the drawings of the '005 patent, the mandrel, in its fully actuated position, cannot assure that a required drift diameter is maintained through the opened valve, in part because of the spacing between the mandrel and the adjacent valve housing wall.

A well bore annulus pressure responsive surge tool is described in U.S. Pat. No. 4,658,902. A tubular cutter mandrel carried within the housing of the tool and shiftable by a separate power mandrel is operable to engage and cut a C-shaped section out of a frangible disc normally blocking the passage through the tool. The cutter mandrel has a longitudinally-extending slot, which leaves a flap portion of the disc uncut. The severed section of the disc, as well as the flap portion, are said to be deflected laterally by the mandrel and retained between the outer surface of the mandrel and the inner surface of the housing. One or more pins must be sheared before the power mandrel can effect shifting of the cutter mandrel toward the disc. Because of the provision of the elongated slot in the cutter mandrel, that mandrel must be shifted through a displacement significantly greater than the length of the slot in the mandrel. In order to accomplish this extended path of travel of the mandrel, two-stage mandrel structure is required, which, along with the pins controlling release of the mandrels, thus adds to the complexity of the mechanism and its attendant cost, and at the expense of overall reliability.

The plug for an oil or gas well bore hole in PCT application PCT/GB97/02043 is described as being a replacement for conventional bursting type plugs that, when pressurized above a certain level, burst in order to open a tubing string. A section of these earlier plugs can break free from the tubing string, thereby resulting in a piece of unwanted equipment at the bottom of the well causing problems at a later time. The plug of the '043 application is made up of a threaded box end, a threaded pin end, an upper tubular body member, and a lower tubular body member. A steel barrier plate, machined from the lower body member, extends across a central bore of the tubing. A cutter having a tapered cutting blade is secured to the lower body member by a shear pin. The cutter is shifted by a movable piston sleeve temporarily held in a retracted position in the lower body member by locking dogs and a slotted lock sleeve. By cycling the pressure within the tubing, the piston sleeve is moved up and down against the action of a spring until a slide bolt enters a selected position in the slotted sleeve. This results in release of the locking dogs, permitting the sleeve to move downward into engagement with the cutter, effecting shearing of the shear pin and allowing the cutter to impact against the barrier plate. Because only a part of the plate is severed, the cut segment thereof is deflected outwardly by the cutter into a recessed section in the box end. This tool is very large and can be used only in large diameter casings. The functional reliability of this very complicated and expensive mechanism under the difficult conditions that exist at the extreme depths of well bore holes is inherently problematical, and renders the unit unsuited for a majority of wells.

A tubing string isolation tool employing a frangible glass disc is described in U.S. Pat. No. RE39,209. The presence of the glass disc permits well fluid from the ground surface to be introduced into the tubing string at an increased pressure to establish a hydrostatic load allowing a packer or any other ancillary device to be hydraulically set in a conventional manner. When the packer or other ancillary device has been set, and it is desired to recover production fluid from the formation, the pressure of the well fluid in the tubing string is increased, thereby applying a pressurized fluid load against a piston which overcomes shear pin resistance and is moved downwardly with sufficient force to shatter the glass disc. Debris resulting from breakage of the disc can amount to formation of glass chunks that are as much as one-fourth to one-half inch in diameter. Debris of this nature is to be avoided because of a variety of close downhole tolerances. If a metal bar is intended to be used to fracture the glass disc, bends in the tubing string may actually interrupt downward movement of the bar, or impede its movement to an extent that it does not have adequate impact force to break the glass disc.

In U.S. Pat. No. 5,996,696, assigned to the assignee hereof, a rupture disc is used to block the flow path through a tubing string in order to permit testing of the integrity of the tubing string connections. After it has been established that none of the tubing sections are leaking, the discs may be ruptured by application of a predetermined overpressure applied to the disc through the string. All tubing string pipe sections have a required drift diameter for a particular pipe i.d. Although the tubing string integrity testing apparatus of the '696 patent has been found satisfactory for many applications, in certain instances, it has been found that the central section of the disc that is ruptured under overpressure does not completely open and fails to fold against the housing of the apparatus, thereby not providing a required drift diameter through the test apparatus.

SUMMARY OF THE INVENTION

The oil well completion tool of this invention overcomes the problems presented by previously available tools. The tool includes a tubular assembly defining an elongated axially-extending main passage with a severable plug being mounted in the tubular assembly in normal blocking relationship to the axial passage. A movable shear cylinder unit within the tubular assembly has a plug-severing edge operable to sever an entire central segment of the plug from the remaining peripheral portion thereof when the shear cylinder unit is moved through a plug-severing displacement. Separate elongated hinge structure within the assembly has an inner elongated leg portion that is secured to the central segment of the plug facing the shear cylinder unit and an outer leg portion joined to an annular member connected to the peripheral portion of the plug. The elongated leg portion of the hinge structure, which is operable by virtue of its connection to the annular member, to retain the plug in the main body of the assembly after severing of the central segment thereof. The hinge structure allows the severed central plug segment to bodily shift independent of and in a direction away from the remaining peripheral annular portion of the plug. An L-shaped tab is provided on the periphery of the central section of the plug opposite the hinge structure. The tab, which is received in a cutout in the plug-severing edge of the shear cylinder, maintains the alignment of the leading edge portion of the shear cylinder with the central segment of the plug.

The severable blocking plug is preferably mounted in the tubular assembly of the tool between a bottom sub and a housing connected to a top sub. A shiftable shear cylinder unit in the housing is movable through a plug-severing displacement by single-acting piston structure forming a part of the housing. The tapered plug-severing edge of the shear cylinder unit functions to progressively sever the entire central segment of the plug from the remaining peripheral portion thereof. The elongated leg portion of the hinge structure, which retains the severed central segment of the plug in the main passage of the assembly as the hinge structure undergoes elongation, thereby allows the central plug segment to shift independent of and in a direction away from the remaining peripheral portion of the plug. By providing a hinge that has an elongated leg portion that is separate from but connected to the central segment of the plug and that may undergo elongation as the central segment of the plug is severed and then deflected laterally by the shear cylinder unit, the severed section of the plug is capable of moving both laterally and longitudinally of the main passage of the tool and into a recess therefore in the wall structure of the tool. As a consequence, the severed section of the plug does not block the main passage, thus assuring that the required drift diameter through the tool is maintained.

The wall structure of the tool tubular assembly and the movable shear cylinder unit cooperate to present a chamber normally at atmospheric pressure with a piston surface facing toward the plug normally blocking the passage through the tubular assembly. When fluid in the chamber is pressurized, thereby exerting a force on the piston surface sufficient to shift the shear cylinder unit, the leading end of the tapered plug-severing edge of the shear cylinder unit first contacts a central segment of the plug to initiate severing of the plug, which continues around the circumference of the plug until the entire central segment of the plug is separated from the peripheral portion thereof. It is preferred that the plug be provided with a cavity in one surface thereof in alignment with the leading end of the shear cylinder unit that first contacts the plug surface. The cavity, which may have a central area of greater depth than the cavity areas on each side thereof, facilitates initiation of severing of the central segment of the plug by the shear cylinder unit.

Any one of a number of pressure or force actuatable devices may be provided for controlling shifting of the shear cylinder unit through the plug-severing displacement thereof. The devices may either be a rupture disc, or a Kobe drop bar activated knockout plug. Use of a rupture disc, in either the wall structure of the tool assembly or the shear cylinder unit, that communicates with the piston chamber, allows actuation of the shear cylinder unit by atmospheric or differential pressure controllable from the surface. Utilization of a rupture disc for this purpose is preferred because that allows the pressure response to be selectively controlled by choice of a rupture disc of predetermined burst characteristics.

The tool of this invention has utility in vertical oil well casings as well as in one or more horizontal casing sections leading away from a vertical well that extends to the surface. It is especially useful in multiple well applications because no debris is left in the hole, whether vertical or horizontal, after opening of the plug to enable production from a well.

Another important feature of the invention is the ability to selectively vary the withstand pressure properties of the blocking plug by changing the thickness of the plug, the materials of construction, and the overall shape of the plug, without adversely affecting full opening of the plug.

Prior art completion tools for the most part operate under specific parameters and operating procedures that do not allow for tool changes and optional configurations in order to account for varying well conditions and procedures.

The design of the oil well completion tool is such that in most typical operations the internal piston-receiving atmospheric chamber is sealed against annulus pressure surrounding the piston and piston housing. Thus, the atmospheric chamber is not negatively affected at normal annulus pressures.

Where very high pressure well conditions must be accommodated when using the oil well completion tool of this invention, there must be adequate compensation for the pressure differential, i.e., the difference between the annulus pressure and the pressure within the tubing string and thereby the tool, in order to prevent overpressure damage to the housing or piston structure of the tool. That high pressure compensation must be provided while full control is retained over selective operation of the tool. In wells where excessive high pressures are encountered, the difference between the well annulus pressure and the atmospheric pressure can be of a magnitude sufficient to collapse the tool housing or shear cylinder wall of the piston in an inward direction toward the atmospheric chamber. To prevent these potentially negative and catastrophic events, a series of holes may be provided in the housing of the tool so that the differential pressure between the inside of the tool and the surrounding annulus is reduced to a mechanically acceptable level, or pressure-compensating holes provided in the piston.

Because the amount of pressure required to effect operation of the tool is a controllable parameter, pressure can be applied from the surface down either the tubing or, alternatively, the casing string, at a level that is sufficiently greater than that of the annulus or tubing in order to effect operation of the tool as may be required.

BRIEF DESCRIPTION OF THE DRAWINGS

FIG. 8 is an enlarged, cross-sectional view through the tubular completion assembly along a horizontal plane and illustrating the bottom of the severable plug;

FIG. 9 is an enlarged, cross-sectional view along the same line as FIG. 8 without the severable plug and the hinge attached thereto;

FIG. 13 is a vertical, cross-sectional view of a second embodiment of the completion tool assembly;

FIG. 14 is a vertical, cross-sectional view of a third embodiment of the completion tool assembly, and that is optionally provided with holes in the piston that communicate with the atmospheric chamber that reciprocably accommodates a portion of the piston during shifting of the latter;

FIG. 15 is a horizontal, cross-sectional view taken substantially on the line 15-15 of FIG. 14 and looking in the direction of the arrows;

DETAILED DESCRIPTION OF THE PREFERRED EMBODIMENT

Figure 1:
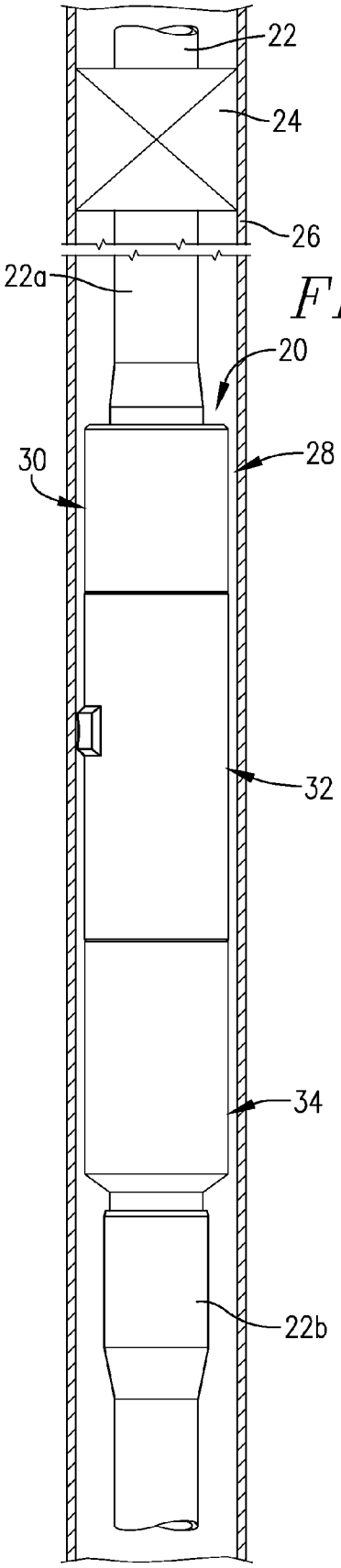
FIG. 1 is a vertical, fragmentary, cross-sectional illustration of a tubing string in which an oil well completion tool assembly in accordance with this invention is located below a schematically-depicted packer.
Figure 2:
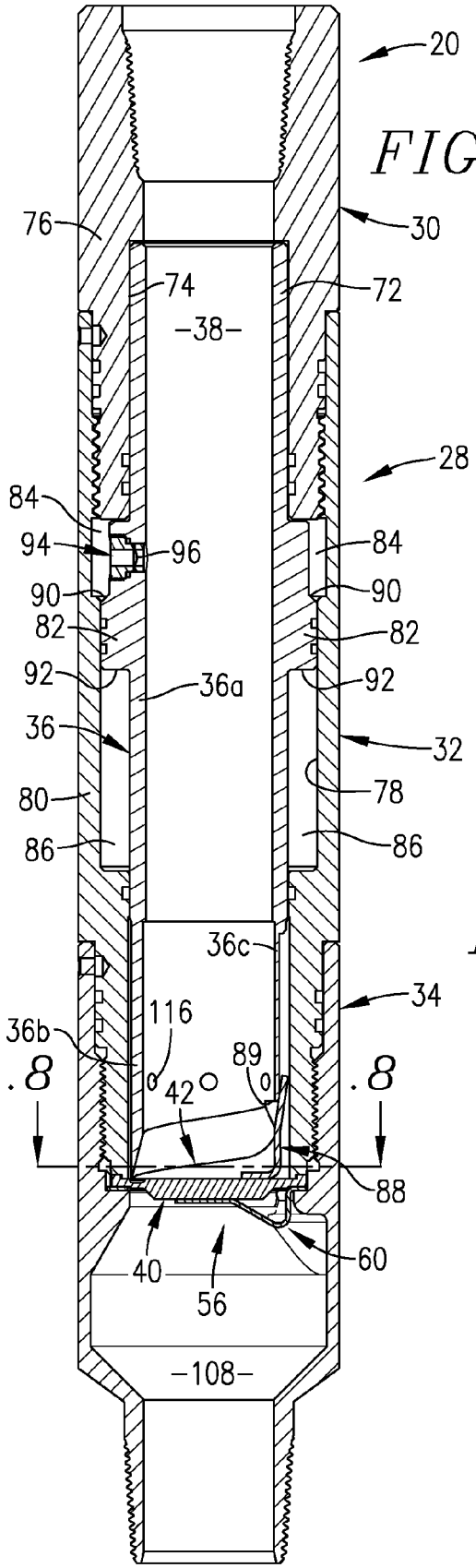
FIG. 2 is a vertical, cross-sectional view of one embodiment of the completion tool assembly, illustrating the shear cylinder unit in its normal position above a severable plug mounted in the tubular assembly in normal blocking relationship to the axial passage of the assembly.

An oil well completion tool 20 in accordance with one preferred embodiment of this invention, shown in elevation in FIG. 1 of the drawings, is depicted as being mounted in a multiple-section tubing string 22 below a diagrammatically-illustrated packer 24 within oil well casing 26. The tool 20 comprises a tubular assembly 28 having an upper threaded box sub 30 adapted to receive a threaded end of the tubing section 22*a*. The housing 32 of assembly 28 is threadably connected to top sub 30 and interposed between sub 30 and lower threaded pin sub 34. The pin sub 34, threadably joined to housing 32, is adapted to be threaded into a section 22*b* of tubing string 22. A shear cylinder unit 36 is shiftably mounted in housing 32 for movement axially of the main passage 38 of tool 20. A severable plug, broadly designated 40, is mounted between adjacent ends of housing 32 and lower sub 34. The plug 40 in its normal position, blocks main passage 38 of tool 20. Plug 40 is preferably of a metal such as Inconel, stainless steel, or an equivalent metal. The lowermost tapered plug-severing edge 42 of shear cylinder unit 36, in the orientation of unit 36 as shown in FIG. 2, has a leading edge segment 42*a* that is in closest proximity to the adjacent surface of plug 40, and opposed trailing edge segments 42*b* that are each at an angle of from about 7° to about 18°, and more preferably from about 11° to about 16°, and most preferably at an angle of about 15° with respect to the longitudinal axis of passage 38. The edge segments 42*a* and 42*b* cooperate to define a circular, tapered plug-severing edge. It is also preferred in this respect that the edge 42 be chamfered at an angle of about 15° from o.d. to i.d. of shear cylinder unit 36.

Plug 40 comprises an assembly having a solid circular body 44 that includes a central, flat-surfaced section 46 having an outer tapered section 48 that merges with an annular peripheral, stepped portion 50 that includes an inner circular segment 50*a* and an outer circular segment 50*b*. It is to be seen from FIG. 5, for example, that the surface 52 of plug 40 opposed to section 46 thereof is essentially flat, except for a circumferentially-extending rim portion 54 at the periphery thereof.

Hinge structure broadly designated 56 within assembly 28 includes an annular member 58 that is secured to the outermost stepped, peripheral surface 50*b* of plug 40. The elongated L-shaped component 60 of hinge structure 56 includes an outermost generally U-shaped section 62 and an outer leg section 64. U-shaped section 62 includes leg portions 66 and 68, with leg portion 68 being joined to outer leg section 64. Leg portion 66 of section 62 is integral with annular member 58. Plug 40 and hinge structure 56 may be fabricated of any one of a number of metals conventionally used in the manufacture of rupture discs, with Inconel being preferred, but 316 stainless steel also being usable, as examples only.

Although the preferred embodiment of plug 40 is as shown in the drawings, having essentially flat opposed surfaces defining the central section 46 thereof, the severable plug may have a central section that is bulged into a concavo-convex shape, with the concave surface facing either upstream or downstream of the pressure source, depending on the well pressure profile and intended purpose of the oil well completion tool 20.

The lower sub 34 has an internally-threaded cavity portion 34*a* that is configured to receive the externally-threaded end portion 32*a* of housing 32. The lowermost end portion 32*a* of housing 32 is provided with an outermost, annular groove 70 that complementally receives the rim portion 54 of plug 40. The rim portion 54 serves to restrain bulging of the body 44 under fluid pressure thereagainst. It is also to be seen from FIG. 5 that the plug 40 is clamped between the lowermost end portion 32*a* of housing 32 and the circumferentially-extending internal grooved portion 34*b* of lower sub 34. By suitable tightening of the threaded interconnection between housing 32 and sub 34, a leakproof, metal-to-metal seal between plug 40 and housing 32 and sub 34 is provided, thus obviating the necessity of providing O-rings gaskets or the like, which could deteriorate over time. The cylindrical interior portion of sub 34 has a cutaway segment 34*d* for receiving section 62 of hinge structure 56.

Figure 3:
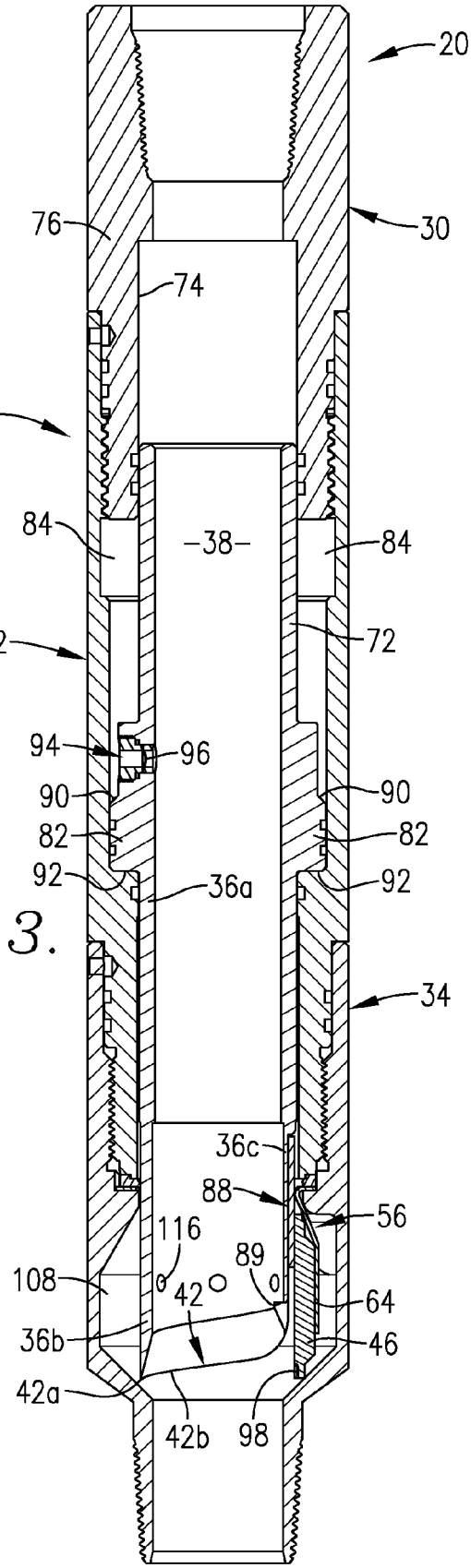
FIG. 3 is a vertical, cross-sectional view of the embodiment of FIG. 2, showing the position of the shear cylinder unit after it has been moved through a plug-severing displacement thereof.
Figure 4:
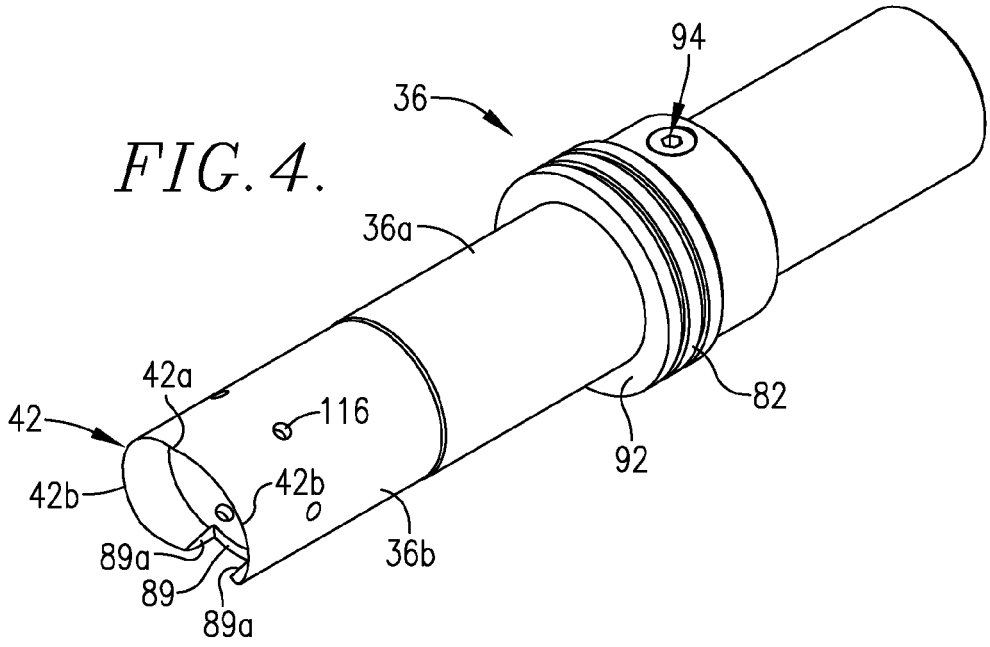
FIG. 4 is a perspective view of the movable shear cylinder unit of the completion tool assembly.

Shear cylinder unit 36 has an elongated tubular body portion 72 received within a circumferentially-extending elongated recess 74 in the wall structure 76 of sub 30, as well as the elongated annular recess 78 in wall structure 80 of housing 32. The recess 78 in housing 32 is stepped and of larger diameter than recess 74. The circumferential piston projection 82, extending outwardly from the cylindrical wall 36*a* of shear cylinder unit 36, contacts the surface of recess 78 and cooperates with that surface to define axially-spaced, circumferentially-extending chambers 84 and 86, respectively. The chamber 86 is of greater area than chamber 84, and in the embodiment of FIGS. 2 and 3, is generally at about atmospheric pressure.

Figure 11:
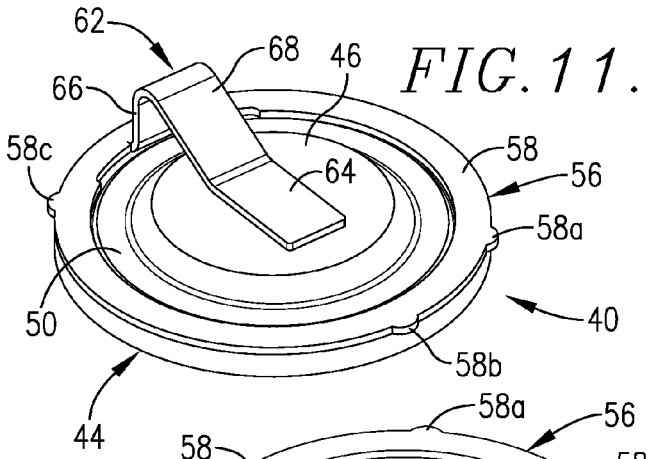
FIG. 11 is a perspective bottom view of the severable plug as shown in FIG. 10.
Figure 12:
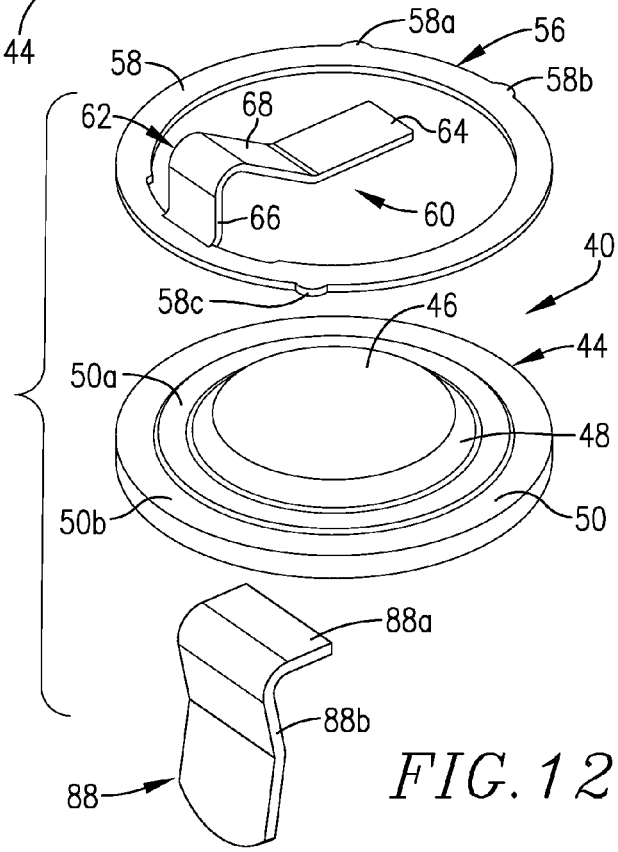
FIG. 12 is an exploded perspective bottom view of the severable plug with the hinge member and its associated annular support member adapted to be attached to the plug body.
Figure 5:
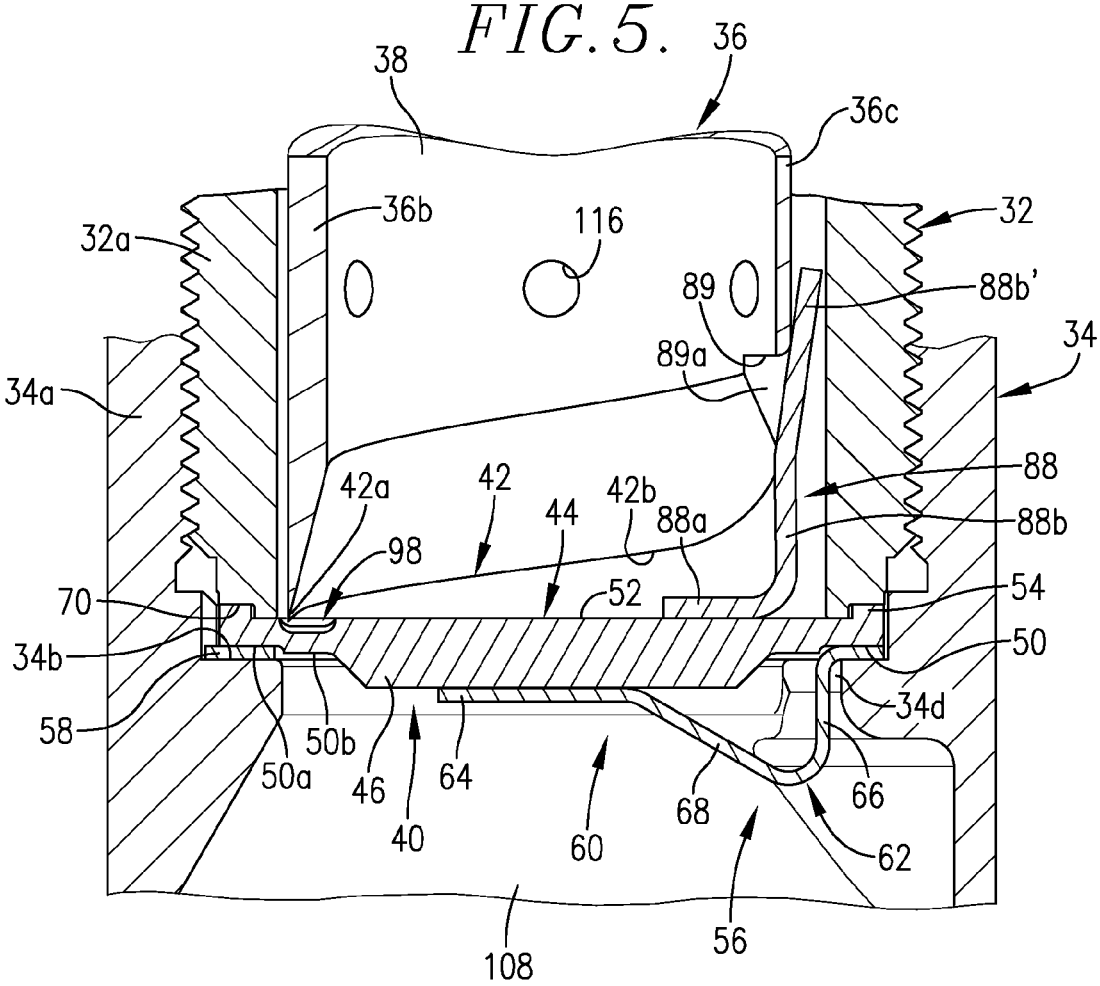
FIG. 5 is a fragmentary, enlarged, vertical, cross-sectional view illustrating the position of the shear cylinder unit prior to severing of the central segment of the severable plug mounted in the tool assembly.

An L-shaped tab 88 mounted on the periphery of the surface 52 of plug 40 engages the lowermost end of shear cylinder unit 36. The tab 88 has a leg portion 88*a* affixed to the surface 52 of plug 40 and an outwardly-directed leg portion 88*b*, which is received in the cutout 89 in the lowermost end 36*b* of shear cylinder unit 36. It can be seen from FIG. 11, that the leg portion 88*b* of tab 88 is curved transversely thereof to complementally engage the beveled surface 36*c* of cutout 89. Leg portion 88*b* of tab 88 is of a width equal to the cross-sectional width of cutout 89, whereby the side edges of leg portion 88*b* engage opposed sides of cutout 89. The wall section 36*c* of the lowermost end 36*b* of shear cylinder unit 36 is of reduced thickness where aligned with tab 88 to accommodate the outer end extension 88*b*, as shown in FIGS. 2, 3, and 5.

During assembly of oil well completion tool 20, as the shear cylinder unit 36 is inserted in housing 32, the leg portion 88*b* of tab 88 is trapped between the outer surface of the reduced thickness cutaway wall section 36*c* of the lower end 36*b* of shear cylinder unit 36, and the innermost surface of housing 32. The cross-sectional curvature of leg portion 88*b* of tab 88 generally conforms to the configuration of transversely beveled surface 36*c* of the outermost end 36*b* of shear cylinder unit 36. Engagement of the side edges of leg portion 88*b* of tab 88 with opposed margins 89*a* of cutout 89 during insertion of shear cylinder unit 36 into the tubular assembly 28 prevents rotation of shear cylinder unit 36 within passage 38 that would occur as a result of the torque applied to the piston as the upper box sub 30 is threaded in place. Accordingly, the leading edge segment 42*a* of shear cylinder unit 36 remains in correct alignment with the portion 40*a* of plug 40, not only during installation, but also during operational shifting of shear cylinder unit 36.

When oil completion tool 20 is subjected to high downhole pressures, which can be as much as 10,000 psi or more, the central section 46 of plug 40 will bow to a certain extent in a direction toward the applied pressure on plug 40. Opposed side edges of leg portion 88*b* of tab 88 remain in engagement with opposed margins 89*a* of cutout 89, even when central section 46 is deflected to a certain extent by the high pressure fluid within the well. Accordingly, there is no tendency for shear cylinder unit 36 to rotate within housing 32 that would cause the edge segment 42*a* of edge 42 to be moved out of its predetermined correctly-aligned position with respect to section 46 of plug 40.

The upper piston shoulder 90 of projection 82 faces chamber 84, while the lower shoulder 92 of projection 82 is in facing relationship to chamber 86. A pair of tubular fittings 94 threaded into opposed sides of wall 36*a* of shear cylinder unit 36 in alignment with chamber 84 each carry a rupturable component 96, preferably comprising bulged pressure-activated rupture discs that are in communication with passage 38 of tubular assembly 28. Upon increase of the fluid pressure in passage 38 of tubular assembly 28 sufficient to effect rupture of discs 96, the fluid pressure in chamber 84 acting on piston shoulder 90 causes the shear cylinder unit 36 to be shifted toward plug 40. Because chamber 86 is at atmospheric pressure, chamber 86 does not offer any significant resistance to the pressure applied to shoulder 90 upon rupture of disc 96.

Rupture disc 96 is preferably provided in a wide range of pressure applications in increments of 200 psi each, such that the appropriate rupture disc can be selected according to well conditions and operations. Typically, a rupture disc is chosen that requires application of fluid pressure of the order of at least about 3500 psi in order to effect rupture of the disc 96, although disc rupture values as high as 10,000 psi may be employed depending upon the operational parameters of a particular well. In addition, the diameter of the aperture of fitting 94 that is opened upon rupture of disc 96 may be varied depending upon the desired speed of shear cylinder unit 36 toward plug 40. Where very high differential pressures must be accommodated between the interior passage 38 of tubular assembly 28 and the surrounding annulus, the diameter of the orifice through fitting 94 may be selected to assure that pressurized fluid flow into chamber 84 is controlled to prevent shear cylinder unit 36 from being directed toward plug 40 at an excessively high rate of movement.

Figure 10:
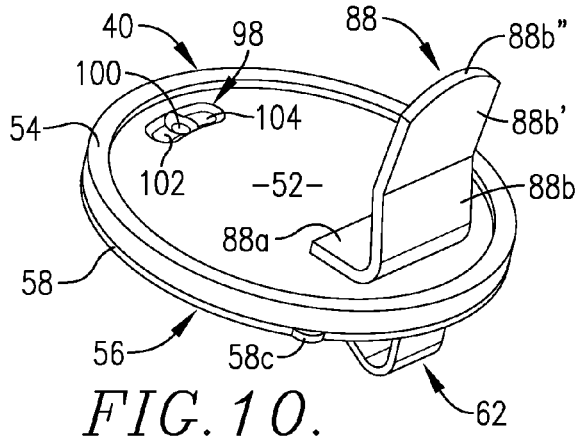
FIG. 10 is a perspective top view of the severable plug with the hinge structure attached to the central segment thereof.

The leading edge segment 42*a* of edge 42 of shear cylinder unit 36 is moved into contact with surface 52 of plug body 44 to initiate progressive severing of the central segment 46 of plug 40 (indicated by the dashed line 46*a* of FIG. 8) from the peripheral portion 50 of plug 40. It is to be noted from FIGS. 2, 5, and 10, that the surface 52 of plug 40 is provided with an elongated cavity 98 in the peripheral portion 50 of plug 40 opposite hinge structure 56. Cavity 98, which is of curvilinear configuration longitudinally thereof, is strategically located inboard of rim 54 in the area of plug 40 initially contacted by leading edge segment 42*a* of shear cylinder 36. Cavity 98 has a center area 100 that is of greater depth than the areas 102 and 104 on opposite sides thereof. Member 58 is preferably provided with at least three integral projections 58*a, b*, and *c* extending outwardly from the outermost circumferential margin of member 58. The spacing between projections 58*a* and 58*b* is less than the spacing from projection 58*b* to projection 58*c*. Thus, projections 58*a-c*, which are complementally received in respective recesses 58*d* therefor (FIG. 9) in sub 34, assure that the plug 40 is positioned with respect to sub 34 in an orientation such that the leading edge segment 42*a* of shear cylinder unit 36 is directly aligned with the center area 100 of cavity 98 in plug 40. Projections 58*a, b*, and *c* are of sufficient size, shape, and quantity to prevent the plug 40 from rotating out of its predetermined clocked orientation with respect to leading edge segment 42*a* of shear cylinder 36 as housing 32 is installed in sub 34.

During shifting of shear cylinder unit 36 by fluid pressure applied against shoulder 90 of piston projection 82 through a displacement to effect severing of the entire central segment 46 of plug 40, the cavity 98 in plug 40 assures that the deformation force initially applied to surface 52 of plug 40 by leading edge segment 42*a* is focused at an area of the plug 40, which is cross-sectionally relatively narrow and of less thickness than the remainder of the peripheral portion 50. The leading edge 42*a* of edge 42 of shear cylinder unit 36 first contacts plug 40 at the center area 100 of cavity 98. Thus, the available force applied to plug 40 by shear cylinder unit 36 is focused directly at an area of plug 40 that ensures initiation of shearing of the plug 40.

Figure 6:
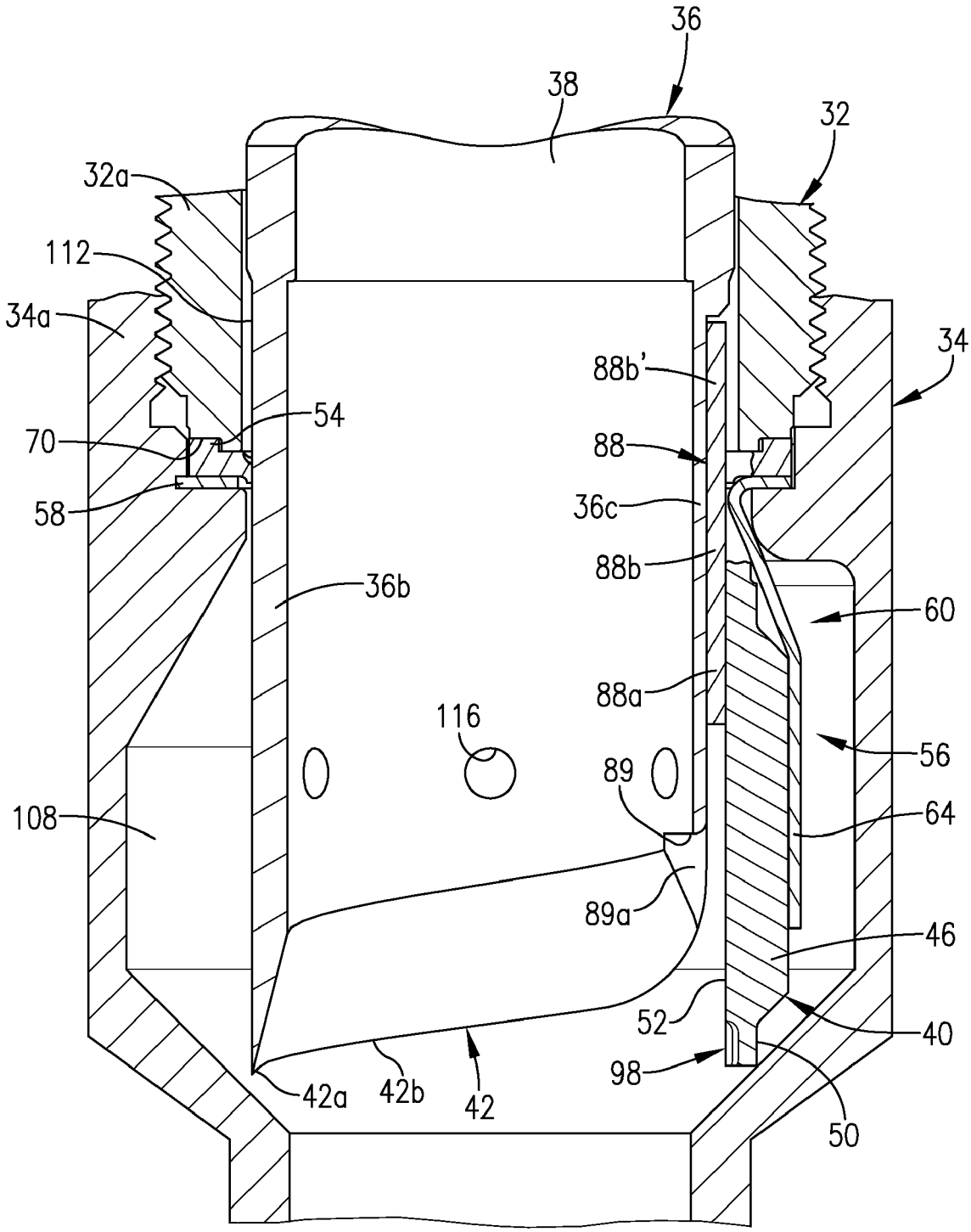
FIG. 6 is a fragmentary, enlarged, vertical, cross-sectional view similar to FIG. 5, but illustrating the shear cylinder unit in its actuated position after it has severed a central segment of the plug.
Figure 7:
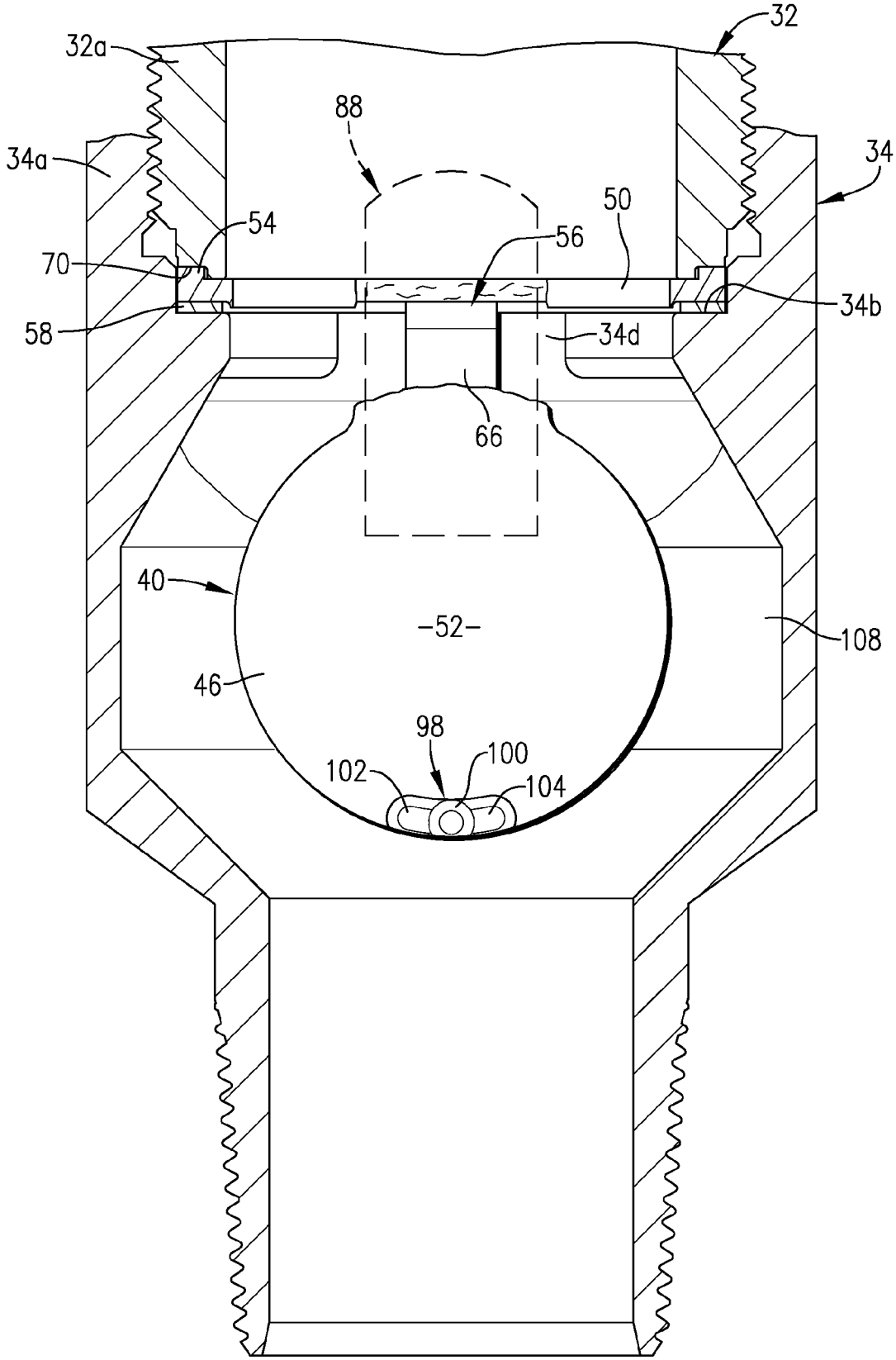
FIG. 7 is a fragmentary, enlarged, vertical, cross-sectional view of the components shown in FIG. 6 at 90° relative to the FIG. 6 depiction.

Upon complete severing of central segment 46 from the peripheral portion 50 of plug 40 by the tapered edge 42 of shear cylinder 36, continued downward movement of the cylindrical outermost end 36*b* of shear cylinder unit 36 deflects the severed central segment 46 outwardly toward the position thereof as shown in FIGS. 6 and 7. The sidewall of sub 34 has a cavity 108 located to receive the deflected central segment 46 of plug 40 and components of hinge structure 56.

As is most evident from FIGS. 3, 6, and 7, when the central segment 46 is severed from peripheral portion 50 of plug 40 by shear cylinder unit 36, the U-shaped section 62 of hinge structure 56 under goes elongation, thereby permitting the severed central segment 46 to not only be deflected laterally, but also to bodily shift independent of and in a direction away from the peripheral portion 50 of the plug 40. The cutout 89 in the lowermost end 36*b* of shear cylinder unit 36 clears the section 62 of hinge structure 56 as shear cylinder unit 36 severs and then deflects central section 46 of plug 40. Full deflection as well as axial shifting of central segment 46 of plug 40 by shear cylinder unit 36 assures that the severed central section 46 of plug 40 moves completely into cavity 108, thereby preventing central section 46 from interfering with the drift diameter of tubular assembly 28. The leg portion 88*b* of tab 88 is straightened out into generally parallel relationship with leg portion 88*a* as leg portion 88*b* is shifted laterally in the area between the reduced wall thickness section 36*c* of shear cylinder unit 36, and the innermost surface of the housing 32. Continued engagement of the side edges of leg portion 88*a* with respective opposed surfaces of cavity 89 prevents shear cylinder unit 36 from rotating as the cylinder unit 36 is shifted through a displacement effecting severing of the central section 46 of plug 40 by the leading edge of shear cylinder unit 36.

Cavity 98 in plug 40 functions to propagate shearing of plug 40 at the point of greatest mechanical load without negative effect on the overall plug pressure rating. The extent of bodily shifting of the severed section 46 of plug 40 axially of the passage 38 of tubular assembly 28 can be varied as desired by increasing or decreasing the length of leg portions 66 and 68 of U-shaped section 62 of hinge structure 56.

A lower part 112 of the end 106 of shear cylinder unit 36 is machined to a smaller diameter than the upper portion of unit 36 in order to provide clearance for end 106 as the shear cylinder 36 moves through its plug-severing displacement. A longitudinally-extending cutaway surface section 36*c* of end 106 on the same side as cutout 89, also provides clearance for the surface 52 of severed central section 46 of the plug 40 as it is being deflected into cavity 108.

The oil well completion tool 120 of FIG. 13 differs from tool 20 in that the fitting 194 provided with a rupturable component, such as a rupture disc 196, is mounted in the sidewall structure 180 of tubular assembly 128. In addition, as shown in FIG. 13, the shear cylinder unit 136 may be made up of an assembly comprising a piston 122 and a shear cylinder 124. In this instance, the tubing string connected to the main passage 138 through tubular assembly 128 is understood to be at essentially atmospheric pressure, as is the chamber 186 that receives an end extremity of piston 122. Fluid pressure is applied down the annulus between the well casing, such as casing 26 of FIG. 1, and the outer surface of tubular assembly 128 to create a pressure differential between the annulus and the interior passage of tubular assembly 128 sufficient to effect rupture of disc 196, thereby causing the pressure introduced into piston chamber 184 acting against piston shoulder 190 of piston extension 182 to move shear cylinder assembly 136 through its plug-severing displacement in the same manner described with respect to the operation of tubular assembly 28.

The oil completion tool 220 of FIG. 14 is structurally the same as tool 120, except in this instance it is understood that the tubing string and the main passage 238 of tubular assembly 228 connected thereto is under a predetermined fluid pressure, which may be the weight of liquid in the tubing string. In order to actuate the shear cylinder unit 236, fluid pressure is applied to the annulus surrounding tubular assembly 228 sufficient to rupture the disc 296 of fitting 294 in the sidewall structure 288 of tubular assembly 228. Upon rupture of disc 296, the fluid pressure against the shoulder 290 of piston projection 282 causes the shear cylinder unit 236 to be moved through its plug-severing displacement, as described with respect to tools 20 and 120.

Oil well completion tool 220 may optionally, for example, be provided with six 0.25 in. diameter holes 298 in shear cylinder piston unit 236 that are spaced 60° apart around the circumference of the piston. The purpose of the holes 298 is to provide compensation for higher than normal annulus pressures in the well without destructive forces being applied to the tool housing 232 and especially the sidewall structure 288 surrounding and forming a part of the atmospheric chamber 286, or the piston 236. In order to actuate tool 220, the annulus pressure in the casing surrounding tool 220 is increased to an amount greater than the pressure in the tubing string and in main passage 238 of tubular assembly 228, thereby causing rupture of disc 296 and shifting of piston 236 toward and into severing relationship with the plug 240.

Figure 16:
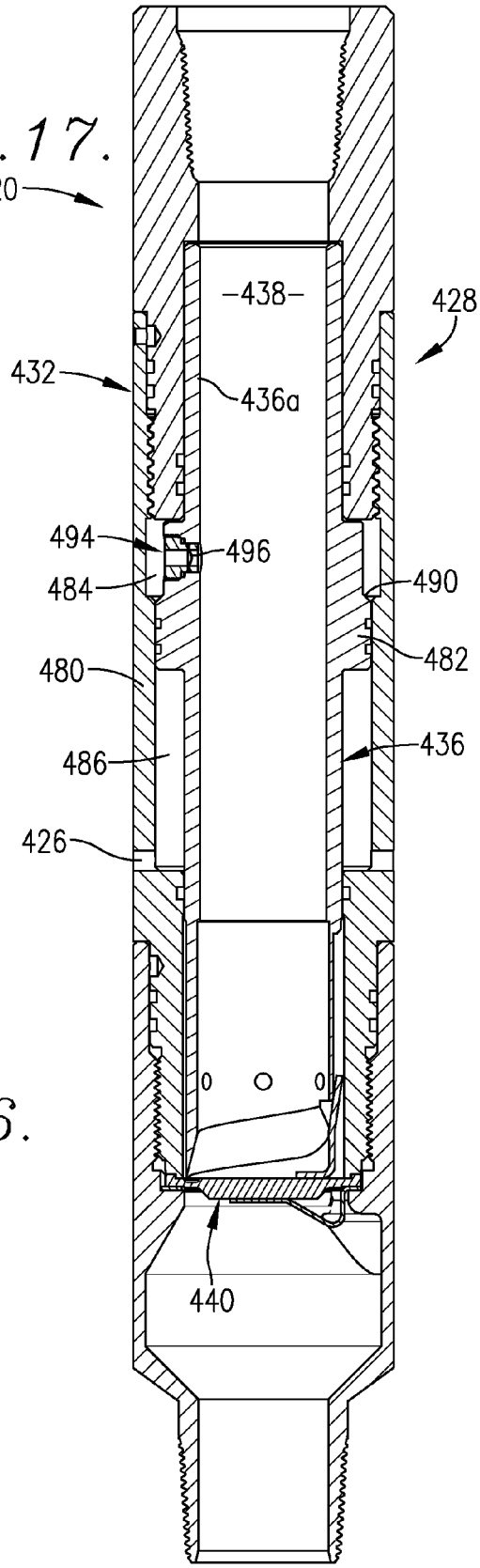
FIG. 16 is a vertical, cross-sectional view of a fourth embodiment of the completion tool assembly.

The oil well completion tool 320 of FIG. 16 is the same as tool 20 except that a Kobe drop bar actuated plug 330 is substituted for the rupture disc component 94 of tool 20. Thus, when a conventional drop bar is dropped through the tubing string connected to the upper sub 376 of tubular assembly 328, the tubular extension 332 of the Kobe plug is broken off, thereby allowing pressurized fluid in the main passage 338 of tubular assembly 328 to be directed into the chamber 384. Pressurized fluid introduced into chamber 384 applied against the piston shoulder 390 of piston extension 382 of shear cylinder unit 336 shifts the assembly through a plug-severing displacement accommodated by atmospheric chamber 341 as previously described with respect to tools 20, 120, and 220.

Figure 17:
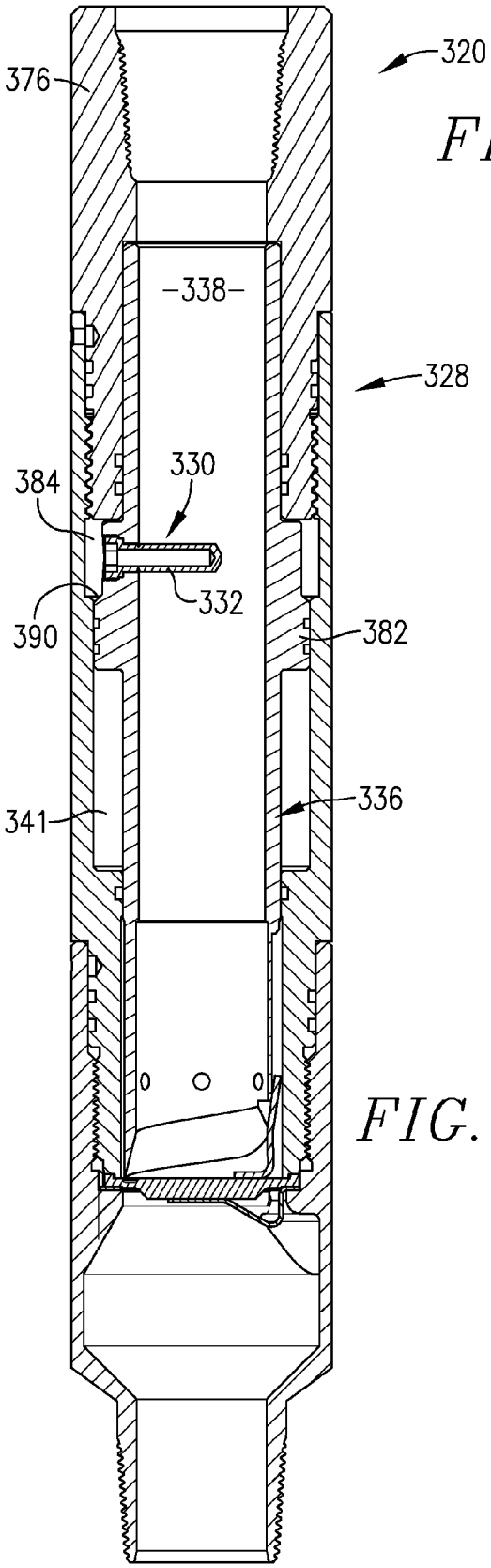
FIG. 17 is a vertical, cross-sectional view of a fifth embodiment of the completion tool assembly.

The oil well completion tool 420 of FIG. 17 is the same as tool 20 except for the provision of a series of orifices 426 in the sidewall structure 480 of housing 432. Again, it is preferred that six 0.25 in. diameter holes 426 that are spaced 60° apart be provided around the circumference of sidewall structure 480. In this instance, the chamber 486, rather than being at atmospheric pressure, is at a pressure equal to the pressure of fluid in the annulus between tubular assembly 428 and the surrounding oil well casing. Thus, by increasing the fluid pressure within the main passage 438 of tubular assembly 428 as compared with the pressure of the fluid in the annulus surrounding tubular assembly 428 and within chamber 486 to a level such that the pressure differential is sufficient to effect rupture of disc 496, the fluid introduced into chamber 486 acting against piston shoulder 490 of piston extension 482 causes shifting of shear cylinder unit 436 through a displacement to effect severing of the plug 440. Because the fluid pressure in chamber 486 remains equal to the pressure in the annulus surrounding tubular assembly 428 by virtue of the provision of holes 426, shifting of the shear cylinder unit 436 under the increased pressure within main passage 438 displaces fluid in chamber 486 through holes 426 into the annulus area around tubular assembly 428.

The design of the oil well completion tool 420, having a series of openings 426 in the sidewall of housing 432 is especially useful for varying well conditions, such as very high pressures, as may occur in very deep wells. Under these high pressure well conditions, it may be necessary to operate the oil well completion tool 420 using differential pressure. Differential pressure, in this instance, is defined as the difference between the pressure in the annulus and the pressure within the tubing string 22. Differential pressure can occur as a matter of well design or geometry or can be created by the application of pressure from the surface to either the tubing or the annulus.

In wells with excessively high pressures the difference between the well pressure and the atmospheric chamber 486 could result in collapse of the housing 432 or burst the piston wall 436 in the direction of the atmospheric chamber 486. Because it has been established what pressure is required to operate completion tool 420, then pressure can be applied from the surface down the tubing string 22 in an amount that is greater than that of the annulus in order to effect proper operation of tool 420.

We claim:

1. An oil well completion tool adapted to be connected to a multiple-section tubing string within an oil well casing and comprising:

a tubular assembly having wall structure defining an elongated axially-extending main passage, said assembly having opposed ends with at least one of the ends being adapted to be connected to a section of the tubing string;

a severable plug mounted in the tubular assembly in normal blocking relationship to the axial passage;

a movable shear cylinder unit in the passage of the assembly provided with a plug-severing edge in normal spaced relationship from a peripheral portion of the plug, said shear cylinder unit being movable through a plug-severing displacement wherein said edge of the shear cylinder unit severs an entire central segment of the plug from a remaining peripheral portion thereof; and separate elongated hinge structure within the assembly connected to the central segment of the plug, said hinge structure being operable to retain the severed central segment of the plug in the main passage of the assembly while allowing the central segment of the plug to bodily shift independent of and in a direction away from said peripheral portion of the plug.

2. An oil well completion tool as set forth in claim 1, wherein said hinge structure is configured to allow for elongation upon severing of the central segment of the plug from the peripheral portion thereof.

3. An oil well completion tool as set forth in claim 1, wherein said hinge structure is connected to said peripheral portion of the plug.

4. An oil well completion tool as set forth in claim 1, wherein said wall structure is provided with a recess for receiving the severed central segment of the plug thereby preventing the severed central segment of the plug from interfering with the main passage through the assembly.

5. An oil well completion tool as set forth in claim 1, wherein said shear cylinder unit includes a tubular piston and a cylindrical plug shearing device, said piston being mounted in the passage of the assembly in disposition to engage and effect shifting of the shear cylinder shearing device toward the plug.

6. An oil well completion tool as set forth in claim 1, wherein said peripheral portion of the plug is provided with a rim, said wall structure of the assembly having a circumferentially-extending shoulder engageable with the rim of the plug.

7. An oil well completion tool as set forth in claim 1, wherein a circular portion of said central segment of the plug is of greater thickness than an annular peripheral portion of the plug.

8. An oil well completion tool as set forth in claim 1, wherein said wall structure and the shear cylinder unit cooperate to form a chamber with a piston shoulder facing toward the plug-severing edge of the shear cylinder unit, and actuatable means permitting activating fluid to be introduced into said chamber against said piston shoulder to shift said shear cylinder unit through said central segment-severing displacement thereof.

9. An oil well completion tool as set forth in claim 5, wherein a rupturable component is provided in said wall structure of the assembly operable to allow fluid pressure to be applied to the piston for shifting the latter to move the shear cylinder shearing device through said central segment-severing displacement thereof upon rupture of the component.

10. An oil well completion tool as set forth in claim 1, wherein said central segment of the plug is provided with a cavity therein adjacent the peripheral portion thereof for initiating severing of the central segment of the plug by said edge of the shear cylinder.

11. An oil well completion tool as set forth in claim 10, wherein said cavity is positioned in opposition to the area of connection of the hinge structure to the assembly.

12. An oil well completion tool as set forth in claim 11, wherein said cavity includes an area that is of greater depth than the depth of a remaining portion of the cavity.

13. An oil well completion tool as set forth in claim 12, wherein said cavity includes portions on opposite sides of said area that are of lesser depth.

14. An oil well completion tool as set forth in claim 10, wherein said cavity is of elongated configuration with an area thereof being of greater depth than a remaining portion of the cavity, said area being located intermediate the ends of the cavity.

15. An oil well completion tool as set forth in claim 10, wherein said cavity is on a side of the central segment of the plug opposite said hinge structure.

16. An oil well completion tool as set forth in claim 6, wherein said cavity is located inboard of and adjacent said rim.

17. An oil well completion tool as set forth in claim 1, wherein said plug-severing edge of the shear cylinder unit is tapered and includes a leading edge segment and trailing edge segments extending at an angle in opposite directions away from said leading edge segment.

18. An oil well completion tool as set forth in claim 17, wherein said trailing edge segments each extend at an angle of about 7° to about 18° with respect to the longitudinal axis of the passage.

19. An oil well completion tool as set forth in claim 17, wherein said central segment of the plug is provided with a cavity therein adjacent the peripheral portion of the plug, said leading edge segment of the shear cylinder unit being in general alignment with said cavity for initiating severing of the central segment of the plug at the cavity by said leading edge segment.

20. An oil well completion tool as set forth in claim 17, wherein said leading edge segment and trailing edge segments are chamfered.

21. An oil well completion tool as set forth in claim 19, wherein said leading edge segments and trailing edge segments are chamfered at an angle of about 15°.

22. An oil well completion tool as set forth in claim 1, wherein said hinge structure includes an annular member affixed to the peripheral portion of the plug, and an elongated, generally L-shaped component having a generally U-shaped leg section and an outer leg section, the U-shaped leg section being defined by interconnected leg portions with one of the leg portions being joined to the annular member and the other leg portion being connected to the outer leg section, said outer leg section being affixed to the central segment of the plug.

23. An oil well completion tool as set forth in claim 22, wherein said U-shaped leg section of the hinge structure is constructed to at least partially straighten out upon severing of the central segment of the plug from the peripheral portion thereof, thereby allowing said bodily shifting of the central segment independent of and in a direction away from the peripheral portion of the plug.

24. An oil well completion tool as set forth in claim 8, wherein said actuatable means includes an actuator extending into the main passage and adapted to be engaged by a drop rod for actuating said actuatable means.

25. An oil well completion tool adapted to be connected to a multiple-section tubing string within an oil well casing and comprising:

a tubular assembly having wall structure defining an elongated axially-extending main passage, said assembly having opposed ends with at least one of the ends being adapted to be connected to a section of the tubing string;

a severable plug mounted in the tubular assembly in normal blocking relationship to the axial passage; and a movable shear cylinder unit in the passage of the assembly provided with a plug-severing edge in normal spaced relationship from a peripheral portion of the plug, said plug-severing edge of the shear cylinder unit being tapered and having a leading edge segment and trailing edge segments extending at an angle in opposite directions away from said leading edge segment;

said central segment of the plug being provided with a cavity therein adjacent the peripheral portion thereof in general alignment with the leading edge segment of the shear cylinder unit, said shear cylinder unit being movable through a plug-severing displacement wherein said leading edge segment initiates severing of the central segment of the plug and the leading edge segment and the trailing edge segments of the shear cylinder unit cooperate to sever an entire central segment of the plug from a remaining peripheral portion thereof.

* * * * *